United States Patent [19]

Jamzadeh et al.

[11] Patent Number: 5,047,791

[45] Date of Patent: Sep. 10, 1991

[54] ELECTROSTATIC COLOR PRINTING APPARATUS

[75] Inventors: Fereidoon S. Jamzadeh, Fairport; Kevin M. Johnson, Rochester; Robert E. Zeman, Webster, all of N.Y.

[73] Assignee: Eastman Kodak Company, Rochester, N.Y.

[21] Appl. No.: 532,832

[22] Filed: Jun. 4, 1990

[51] Int. Cl.[5] ..... G03G 15/01

[52] U.S. Cl. ..... 346/157; 355/327

[58] Field of Search ..... 346/157; 355/326, 327

[56] References Cited

U.S. PATENT DOCUMENTS 4,408,301 10/1983 Iida .
4,706,099 11/1987 Suzuki .
4,796,054 1/1989 Maeno et al. .
4,806,973 2/1989 Kishimoto et al. ..... 355/327
4,872,037 10/1989 Kasahara et al. .

*Primary Examiner*—George H. Miller, Jr.
*Attorney, Agent, or Firm*—Leonard W. Treash

[57] ABSTRACT

A color printing apparatus forms a series of electrostatic images on an image drum, tones them with different color toners and transfers the toner images to a receiving sheet to form multicolor images. The beginning and end of transfer of each image create mechanical discontinuities in the motion of the drum because of engagement and disengagement of the receiving sheet or its edges in a pressure transfer nip. The image-forming process is designed so that significant image scanning does not occur during the discontinuities.

14 Claims, 12 Drawing Sheets

FIG. 10
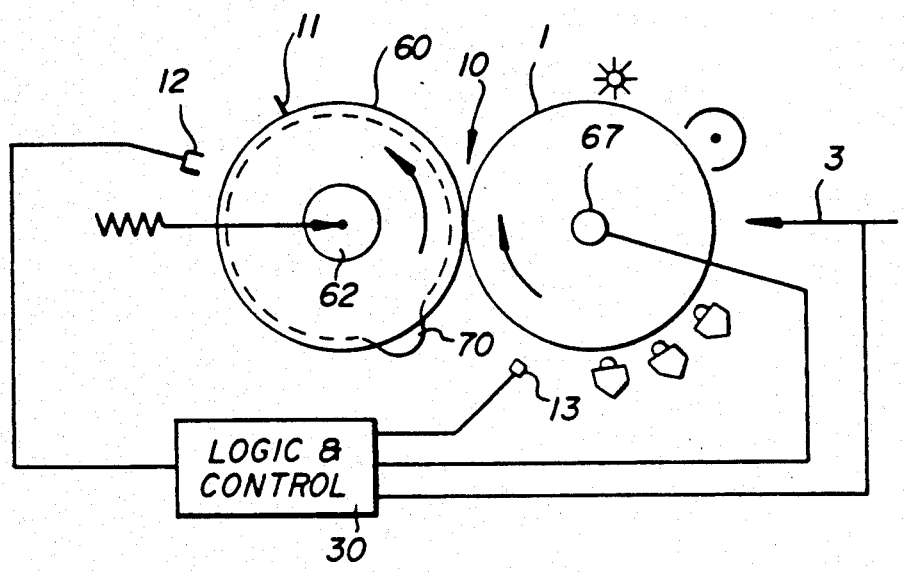
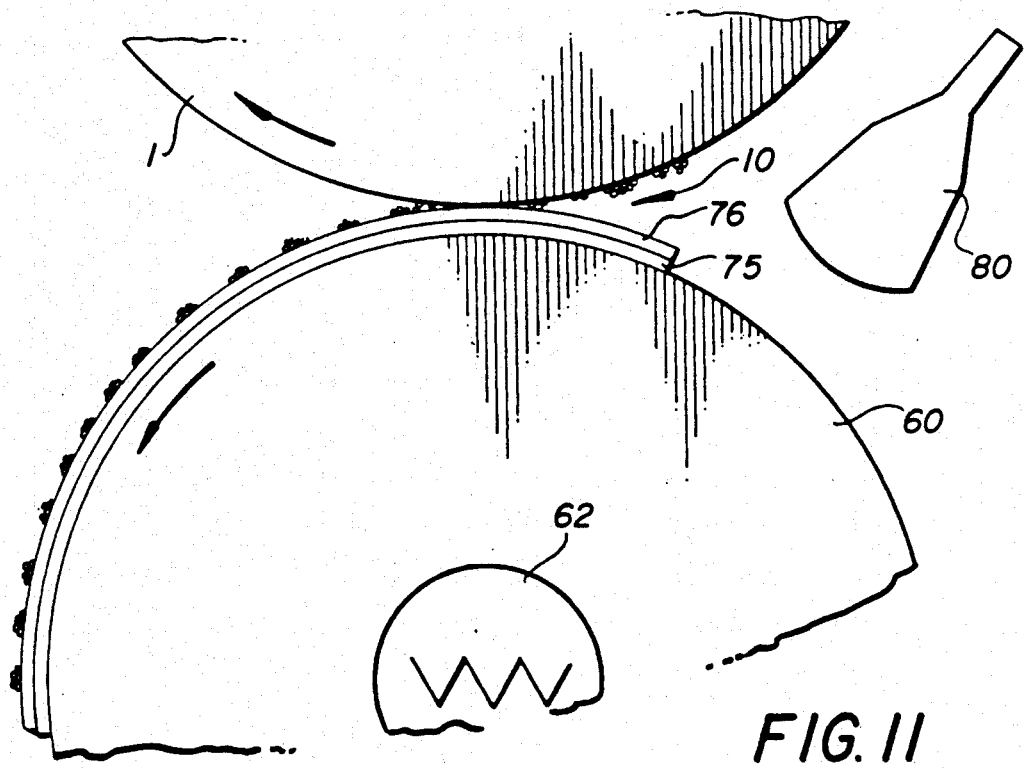
FIG. 11

ELECTROSTATIC COLOR PRINTING APPARATUS

RELATED APPLICATIONS

This application is related to co-assigned:

U.S. patent application Ser. No. 533,237, filed June 4, 1990, MULTICOLOR IMAGING METHOD AND APPARATUS, Jamzadeh et al; now U.S. Pat. No. 4,994,827;

U.S. patent application Ser. No. 532,831, filed June 4, 1990, MULTICOLOR IMAGING APPARATUS WITH IMPROVED TRANSFER MEANS; Johnson; and U.S. patent application Ser. No. 07/488,546, filed Mar. 5, 1990, MULTICOLOR IMAGE FORMING APPARATUS, Jamzadeh et al.

TECHNICAL FIELD

This invention relates to the formation of multicolor images, particularly multicolor images formed by creating a series of single color toner images and transferring those toner images in registration to a receiving sheet. This invention has particular utility in extremely high quality electrophotographic multicolor processes in which the series of single color toner images are formed by imagewise scanning a rotating photoconductive drum.

BACKGROUND ART

In conventional color electrophotography a series of electrostatic images are created on an image member. The images are toned with different colored toners and then transferred in registration to a receiving surface to create a multicolor toner image. The receiving surface is usually a receiving sheet of paper or similar material which has been secured around the periphery of a transfer roller. The transfer roller is rotated in contact or near contact with the image member to repeatedly bring the receiving surface into transfer relation with the consecutive images to overlay them in registration.

The photofinishing industry worldwide thrives on a few commonly desired sizes of prints. In the United States, for example, nearly all prints are either (in inches) 4×6, 5×7, 8×10 or 11×17. Most photofinishing operations produce many more of the smallest size (4×6) than of the larger sizes. However, some flexibility is necessary in all machines that are not dedicated 100% to snapshots. In silver halide photofinishing, this flexibility is supplied by supplying photographic paper in roll form, exposing and processing whatever pictures in whatever sizes are programmed into the printer and then cutting the prints to size later.

In electrophotography, conventional commercial color apparatus requires the use of cut sheets. That is, a single cut receiving sheet is positioned on the periphery of a transfer roller, the roller is rotated through a nip with a toner image carrying image member once for each color to be transferred, and a multicolor image is thereby formed on the receiving sheet.

To compete with conventional photography in making prints, extremely fine toners are necessary. It is presently possible to tone images with toners as small as 3.5 microns and smaller which toners provide extremely high quality images if correctly registered. Transfer of extremely fine toners is difficult to do electrostatically. Better results are obtained by a combination of heat and pressure.

If substantial pressures are used in the transfer process, for example, pressures in excess of 40 pounds per square inch, and both the transfer roller and image drum are independently driven, excessive wear will result to the surfaces in contact, which wear is especially damaging to a photoconductive surface of the imaging drum.

U.S. patent application Ser. No. 07/488,546 to Jamzadeh et al, filed Mar. 5, 1990, deals with problems associated with maintaining registration in a system in which the transfer roller is driven by an imaging member such as a photoconductive drum. According to that application, to maintain extremely precise registration for full utilization of extremely fine toner particles and high quality exposure, the transfer roller is separated from the image member and reindexed for every revolution of the transfer roller. This particular approach provides extremely precise registration of the individual color images to form a multicolor image that has both high resolution and freedom from color misregistration.

Unfortunately, engagement and disengagement of the transfer roller from the photoconductive drum can create a small discontinuity in the motion of the drum. If the image is being formed by an optical or electronic scanning device which is scanning at the time of the motion discontinuity, the scan itself can be affected, resulting in an image defect. This is especially true if image formation is by laser which can be in the middle of a single scan line when the drum is jarred by reengagement of the transfer roller.

Present commercial color copiers using photoconductive drums presently use a flywheel to steady the motion of the drum during scan. The flywheel increases the power required from the drum drive. Further, an image defect that is more than acceptable in a conventional color copier, may be totally unacceptable in photofinishing.

In systems in which the transfer roller and photoconductive drum maintain contact and are not disengaged for reindexing, the passage of the edges of the transfer sheet through a nip involving substantial pressure between the sheet and drum also provides a discontinuity to the motion of the drum that can cause an image defect to a scanning operation in the highest quality work.

DISCLOSURE OF THE INVENTION

It is an object of the invention, to provide apparatus for forming multicolor images generally of the type in which a series of different color images are formed on an image drum and transferred to a receiving sheet carried by a transfer roller but which apparatus reduces the effect of discontinuities in the motion of the drum caused by variations in the engagement between the roller and drum.

This and other objects are accomplished by choosing the size of the drum and the position of the image forming means so that the discontinuity in the motion of the drum caused by engagement of the drum and transfer roller does not occur during a significant part of the image formation process.

According to a preferred embodiment, a color printing apparatus includes an image drum rotatable through an endless path, and a scanning means for forming a series of large electrostatic images on the drum. Each large image is made up of an array of smaller images, the array having at least one boundary between smaller images that runs generally in a cross-track direction.

The image forming means is positioned to be incrementally forming the cross-track boundary between smaller images when the discontinuity in the rotation of the drum occurs.

According to a further preferred embodiment the array of smaller images are laid out in the large image with boundaries between smaller images generally dividing the larger image in equal thirds. With the image formation means, for example, a stationary laser scanner, positioned approximately 180° from the center of the nip between the photoconductive drum and the transfer roller, image discontinuities associated with the beginning and end of transfer to a receiving sheet that is essentially the same size as the large image will occur at approximately the cross-track boundaries between the smaller images.

With this invention any discontinuity that occurs because of the edges of the transfer sheet or the engagement and disengagement of the transfer roller at the edges of the transfer sheet are placed at or close to the boundaries of images where they are either totally invisible to the operator or of very little consequence. This system is particularly usable with a receiving sheet that is 12 inches by 18 inches upon which nine 4×6 inch smaller images are formed. The receiving sheet is later cut according to the smaller images to form nine snapshots.

BRIEF DESCRIPTION OF THE DRAWINGS

In the detailed description of the preferred embodiment of the invention presented below, reference is made to the accompanying drawings, in which:

FIG. 10 is a side schematic of a portion of an embodiment of the apparatus shown in FIG. 1 illustrating another mechanism for moving the transfer roller with respect to the imaging drum.

FIG. 11 is a partial cross-section of the transfer roller and imaging drum shown in FIG. 10 illustrating a preferred form of transfer.

BEST MODE OF CARRYING OUT THE INVENTION

Figure 1:
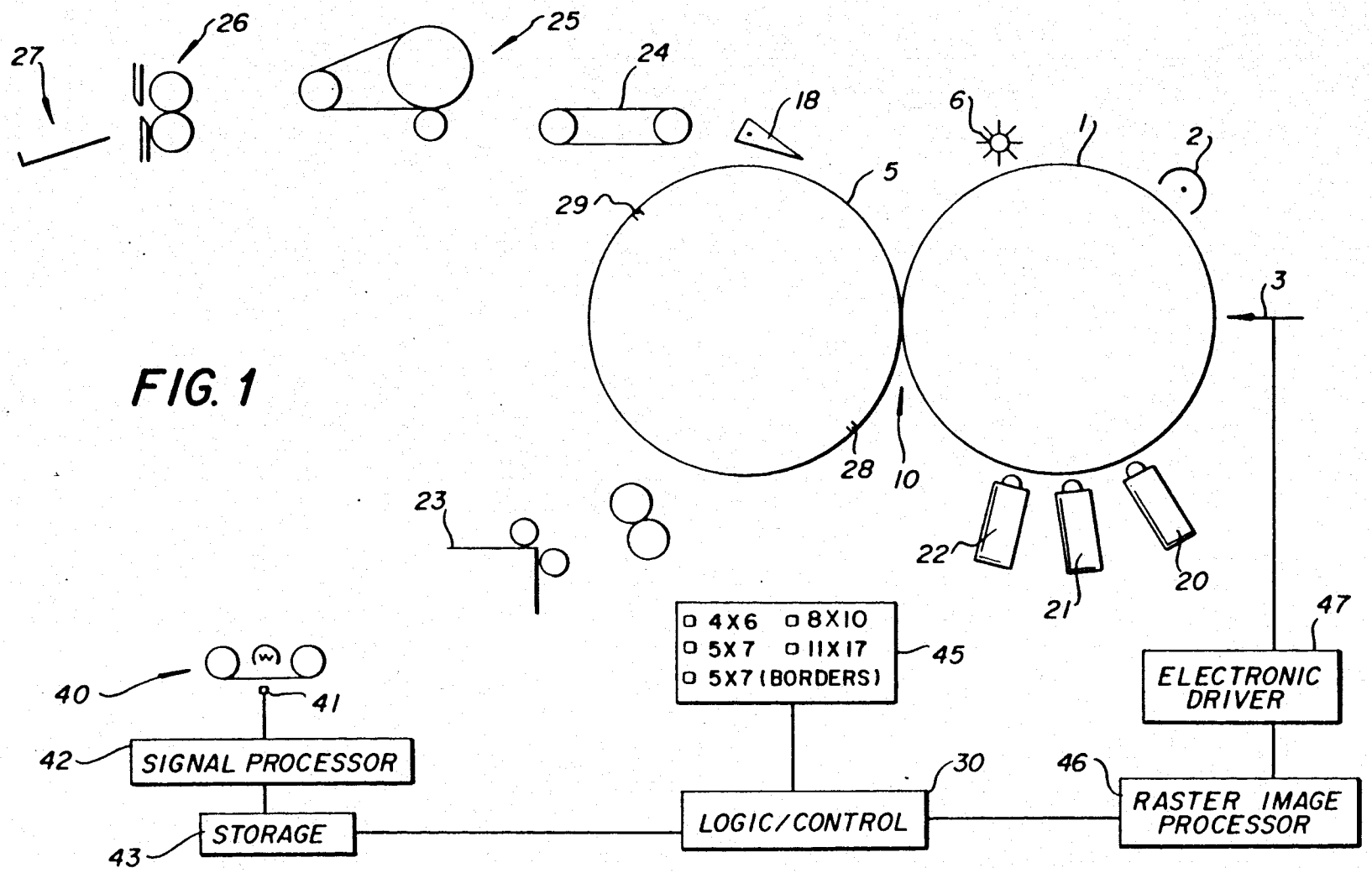
FIG. 1 is a side schematic of a multicolor image forming apparatus.
Figure 2:
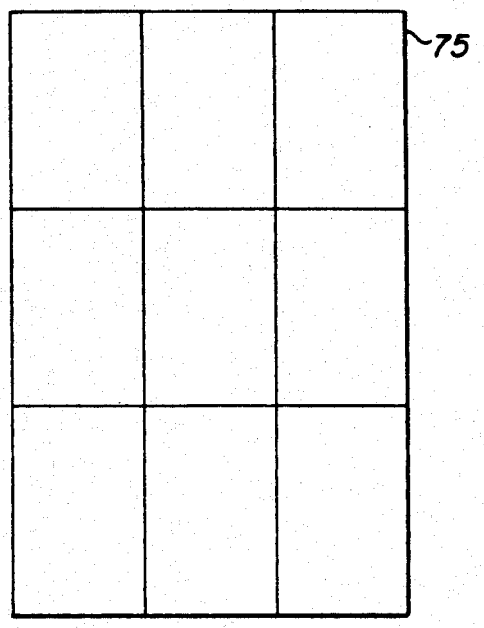
FIGS. 2, 3, 4 and 5 are top views illustrating receiving sheets having various size image areas prior to cutting.

FIG. 1 illustrates a multicolor image forming apparatus utilizing electrophotography. Most of it is conventional. An image member, for example, a photoconductive drum 1, is rotated by a motor, not shown, past a series of electrophotographic stations, all well-known in the art. A charging station 2 uniformly charges the surface of the drum 1. The uniformly charged surface is exposed at an exposure station, for example, laser exposure station 3, to create a series of electrostatic images, each representing a color separation of a multicolor image to be formed. The series of electrostatic images are toned by different color toner stations 20, 21 and 22, one different color for each image, to create a series of different color toner images. The images are then transferred in registration to a receiving sheet carried on the periphery of a transfer roller 5. The drum 1 is cleaned by cleaning station 6 and reused.

The receiving sheet is fed from a receiving sheet supply 23 into a nip 10 between drum 1 and roller 5. As it approaches nip 10 it is secured to drum 5 by a vacuum means, gripping fingers or other mechanism. For example, the leading end of the sheet can be secured by a row of vacuum holes 28 and the trailing end by a row of vacuum holes 29.

After all 3 (or 4) color separation toner images have been transferred to the surface of the receiving sheet, the leading edge of the receiving sheet is stripped from roller 5 by stripping mechanism 18. The receiving sheet is pushed by further rotation of roller 5 onto a sheet transport 24 which carries it to a fixing device 25 and then to a cutter 26. After the sheet has been cut by the cutter 26 the resulting prints are collected in a tray 27 or more sophisticated print collecting device.

The input for exposure station 3 begins with a color scanner 40 which includes a color responsive CCD 41 for scanning an original to be printed, for example, 35 mm color negative film. The output from CCD 41 is fed to a signal processor 42 which converts the CCD signal into a form suitable for storing in memory. For example, signal processor 42 can use suitable compression algorithms to save on storage, enhance the image in both its color aspects and its resolution including color masking, halftone screening, etc. all processes well known in the art. After such signal processing, the image information is stored in a suitable storage 43. Because this system demands substantial storage, a preferred form of storage is a system using magnetic disks.

A logic and control 30 is capable of accessing the storage 43 and also receives inputs from various portions of the machine including encoders (not shown) on drum 1 and roller 5 and various stations to manage the timing of the entire apparatus. One of the inputs to logic and control 30 is a print size designation portion 45 of an operator control panel. As shown in FIG. 1, the operator can press a button beside any of four print sizes ranging from 4×6 through 5×7, 8×10, 11×17 and also 5×7 with borders. The logic and control 30 then receives the input from the print size designation portion 45 and the memory 43 and supplies that information in an appropriate form to raster image processor 46 which lays out the bit map for the ultimate exposure. The output from the raster image processor 46 is fed to an electronic driver 47 for electronic exposure station 3 to control the intensity of a laser, LED printhead, or the like, making up that station.

Prior electrophotographic color apparatus capable of providing a variety of sizes of sheets has a sheet supply 23 which can be loaded with different sizes of sheets and a transfer drum 5 which is capable of holding different size sheets. These devices have specific complexities that are undesirable in such apparatus including the flexibility in the sheet supply and other portions of the paper path. However, the most serious problems arise in securing the sheets to transfer roller 5. If both the leading and trailing edge of the sheet are to be held by a vacuum means 28 and 29 as shown in FIG. 1, those vacuum means must be separated by different lengths of the drum periphery for different size sheets. The drum being the same size, small prints will be produced at the same slow rate that larger prints are produced. More significantly, image quality in the large sheets will suffer from the vacuum holes that are necessarily under their image areas.

To solve this problem, the apparatus as shown in FIG. 1 is capable of taking a single large size sheet, for example, 12 inches by 18 inches. Only 2 sets of vacuum holes are provided and the apparatus is optimized for productivity for the single size sheet. The sizes are chosen to allow later cutting for the print size produced. Examples of preferred image locations for different sizes of image are shown in FIGS. 2–5. According to FIG. 2 a 12 inch by 18 inch receiving sheet 75 can hold nine 4×6 images exposed edge-to-edge with no waste. The other common sizes will produce some waste with a 12×18 inch receiving sheet. Although vacuum holes 28 and 29 will in fact be under the very leading and trailing edges of the receiving sheet 75, they can be limited to the leading and trailing one quarter inch where such defects are least likely to be noticed. Alternatively, a narrow leading and trailing margin can be provided and later trimmed.

Figure 3:
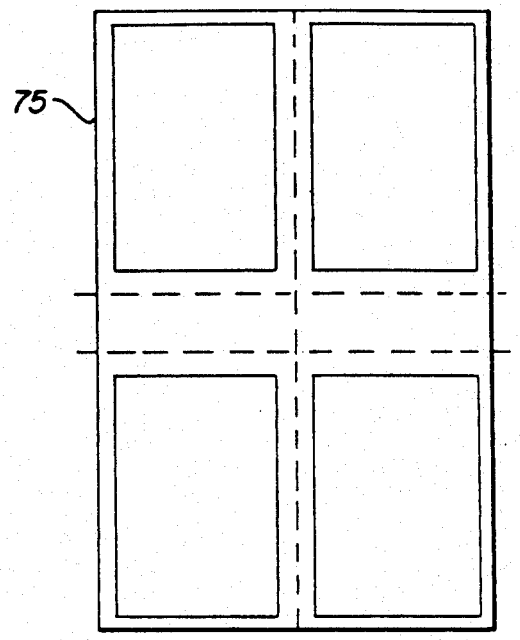
Figure 4:
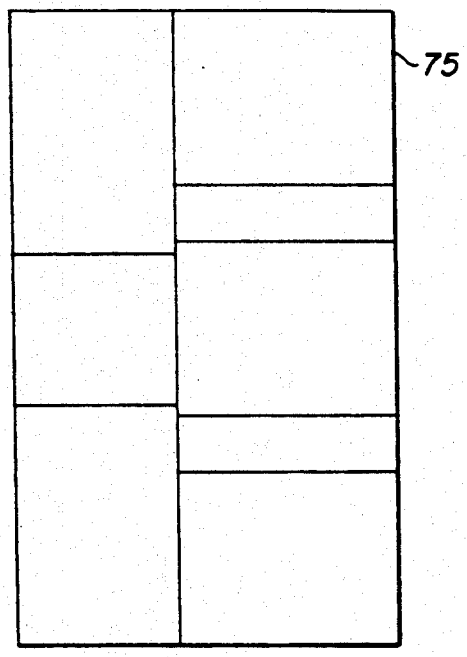

FIGS. 3 and 4 show two approaches to positioning 5×7 images on a 12×18 receiving sheet. Other such arrangements for 5×7's can be designed. The FIG. 4 arrangement is the most efficient, fitting five 5×7's on a 12×18 receiving sheet. The FIG. 3 arrangement fits only four 5×7's in the same space, but has several advantages. A primary one is that if the receiving sheet is cut along the dotted lines shown in FIG. 3, a ½ inch border is provided for each print. Further, the cutting itself is far simpler than that in FIG. 4. Although automatic equipment is available that will cut and slit the geometry shown in FIG. 4, equipment to cut that geometry shown in FIG. 3 is far simpler.

Figure 5:
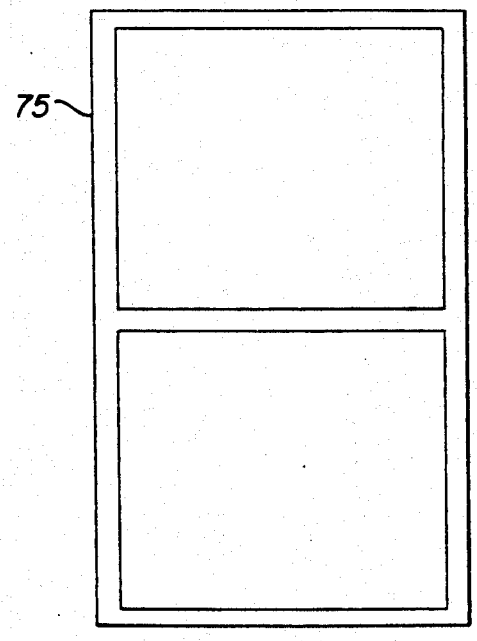

FIG. 5 illustrates two 8×10 images on a 12×18 receiving sheet. With this geometry, if the sheet is cut exactly in half the 8×10's will have ½ inch borders on the top and bottom and 1-inch borders on the sides. The 11×17 format is not illustrated. It, of course, would fit on a 12×18 with half-inch borders on top, bottom and both sides.

Although snapshots are popular without a border, larger prints often are mounted with a border. The 12×18 size allows production of four 5×7's, two 8×10's and one 11×17 with even borders. It is presently within the skill of the art to provide a selection of colors for borders produced on color copiers. This same technology can be used to permit choice of border color for each print larger than 4×6 in the apparatus shown in FIG. 1, by exposing the border area uniformly for one or more of the color separations.

The 12 inch×18 inch size is particularly useful in the United States with the standard print sizes discussed above. Most of these sizes have been standard in the United States for printing from 35 mm film for more than 40 years. However, other size receiving sheets may be optimum for other circumstances. For example, in markets in which 4×6 is not the high volume size, integer multiples of whatever that size is is a preferred starting point in determining the preferred receiving sheet size. Further, if customers prefer snapshots with borders, which are not presently popular, then the receiving sheet would either have to be made larger by the amount of the borders, or the image area reduced in size. Other arrangements could include a combination of different size prints from the same receiving sheet, for example, seven 4×6 prints and one 5×7. All of this is well within the skill of the art within the general framework of this description.

The slitting, chopping or cutting arts are extremely well developed. Devices are presently available that can be set to slit or cut any sheet at a variety of locations. However, a medium volume photofinishing operation may install a less expensive automatic cutting device that cuts only a single high volume print, for example, 4×6 snapshots and allows all other sizes to be trimmed by hand. In such a device the cutter 26 would be either disableable or there would be a path around it for sizes larger than the high volume size.

The process illustrated in FIG. 1 can be capable of extremely high-quality imaging. The quality of that imaging is dependent on many portions of the process. In particular, it is dependent on the resolution of the exposure device 3, the size of the toners used to create the toner images and the registration associated with the exposure and transfer stations. To complete with ordinary photography in making prints, extremely fine toners are necessary. It is presently possible to tone images with toners as small as 3.5 microns and smaller which toners provide extremely high-quality images if correctly registered.

Transfer of extremely fine toners is difficult to do electrostatically. Better results are obtained by a combination of heat and pressure. If substantial pressures are used in the transfer process, for example, pressures in excess of forty pounds per square inch, and both the transfer roller and the image drum are independently driven, excessive wear will result to the surfaces in contact, which wear is especially damaging to the photoconductive surface of the imaging drum. U.S. Pat. application Ser. No. 07/488,546 to Jamzadeh et al, MULTICOLOR IMAGE FORMING APPARATUS, filed Mar. 5, 1990, deals with problems associated with maintaining registration in a system in which the transfer roller is driven by an imaging member such as photoconductive drum 1. According to that application, to maintain extremely precise registration for full utilization of extremely fine toner particles and high quality exposure, the transfer roller is separated from the image member and reindexed for every revolution of the transfer roller. This particular approach provides extremely precise registration of the transfer roller 5 and is illustrated in FIGS. 6–10.

Figure 6:
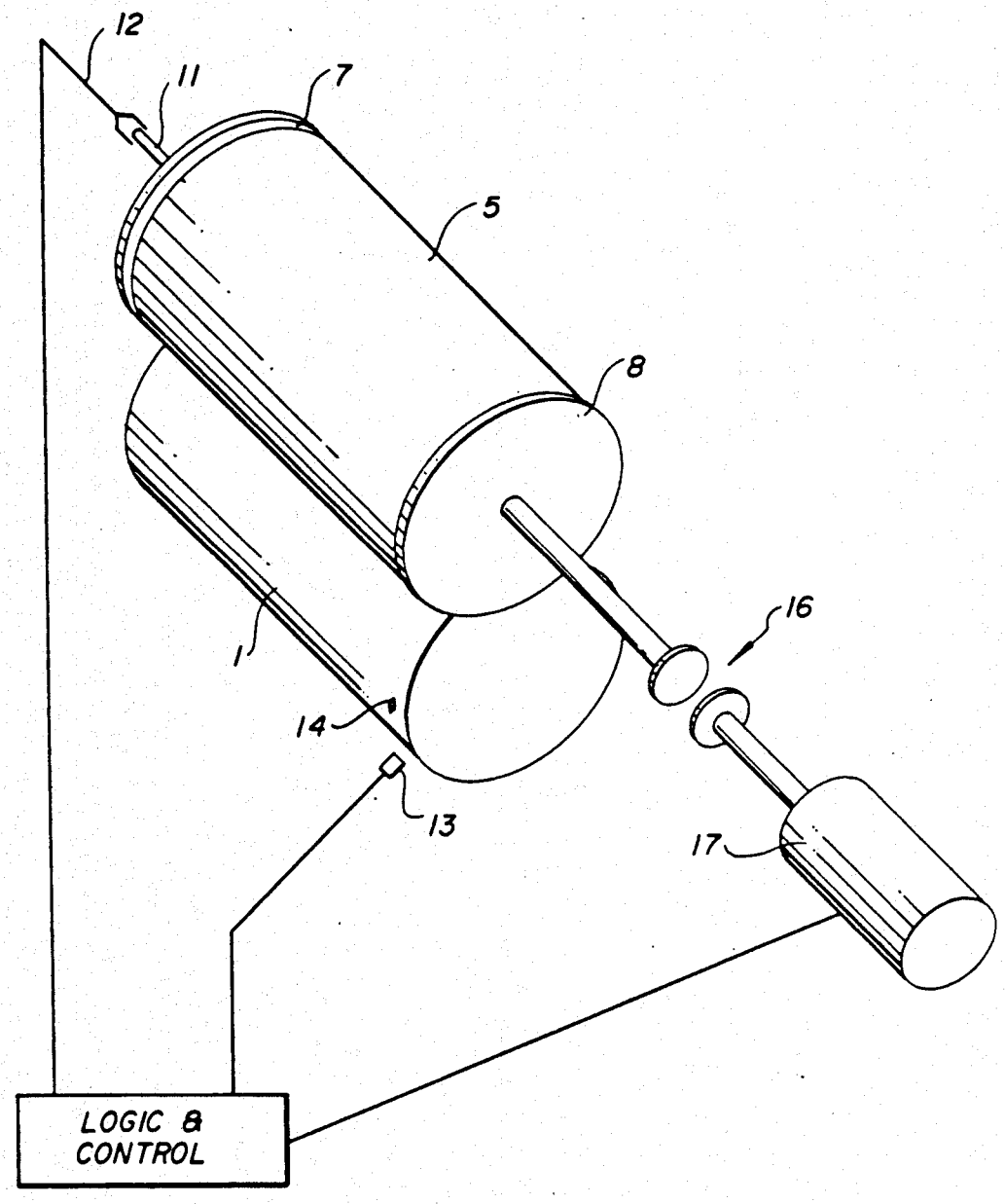
FIG. 6 is a perspective view of an embodiment of a portion of the apparatus shown in FIG. 1, with many parts eliminated for clarity of illustration.

According to FIG. 6 transfer roller 5 has a pair of cam disks 7 and 8 of the same diameter as roller 5 but centered about a different axis. They are fixed to roller 5 and are rotated with roller 5. Roller 5 is rotated by engagement with image member 1 during transfer. When transfer is finished, cam disks 7 and 8 acting either directly on drum 1 or on separate disks (not shown) journaled on the same shaft as drum 1, separate roller 5 from engagement with drum 1. After such separation, roller 5 is driven by a stepper motor 17 through a clutch 16. Roller 5 is driven by motor 17 to a home position controlled by an indicia 11 associated with roller 5 and sensed by a sensor 12. From the home position, motor 17 drives roller 5 up to its appropriate speed and rotational position for reengagement as controlled by disks 7 and 8.

Figure 7:
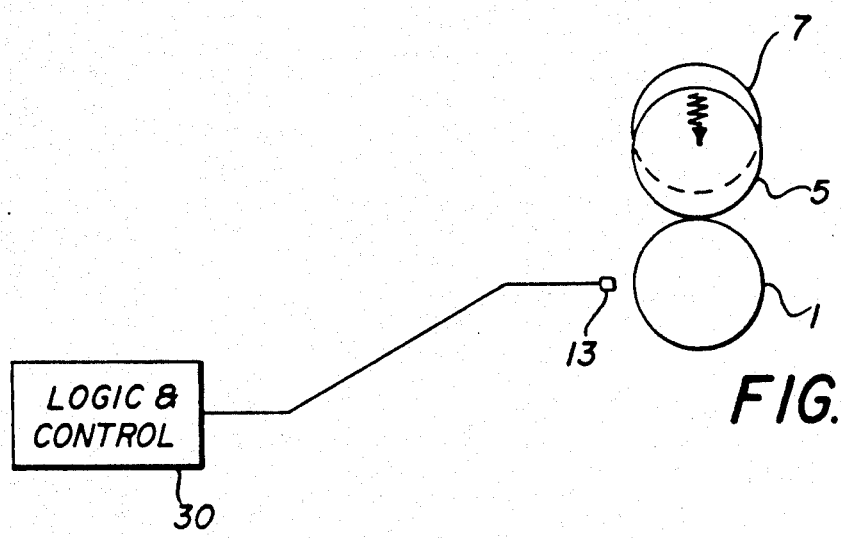
FIGS. 7, 8 and 9 are side schematics of the apparatus portion shown in FIG. 6 illustrating the relative movement of a transfer roller with respect to an imaging drum.
Figure 8:
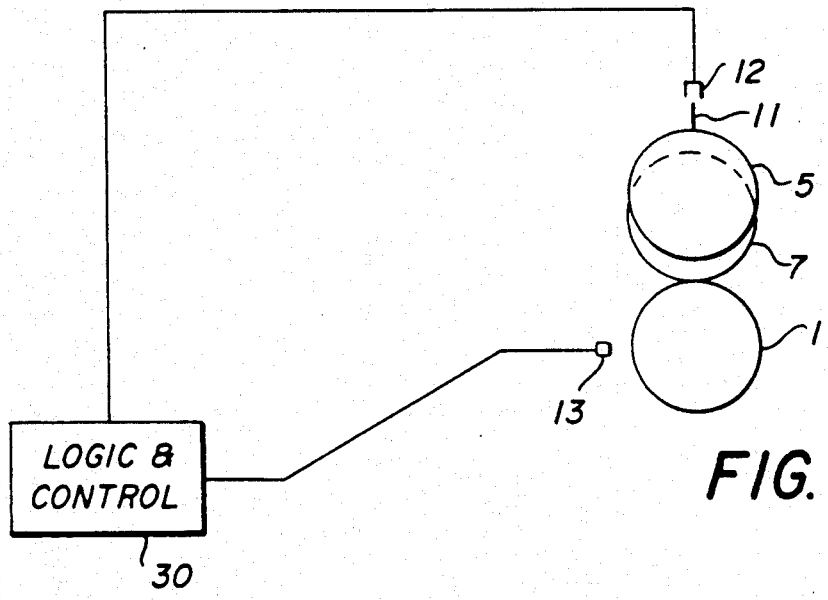
Figure 9:
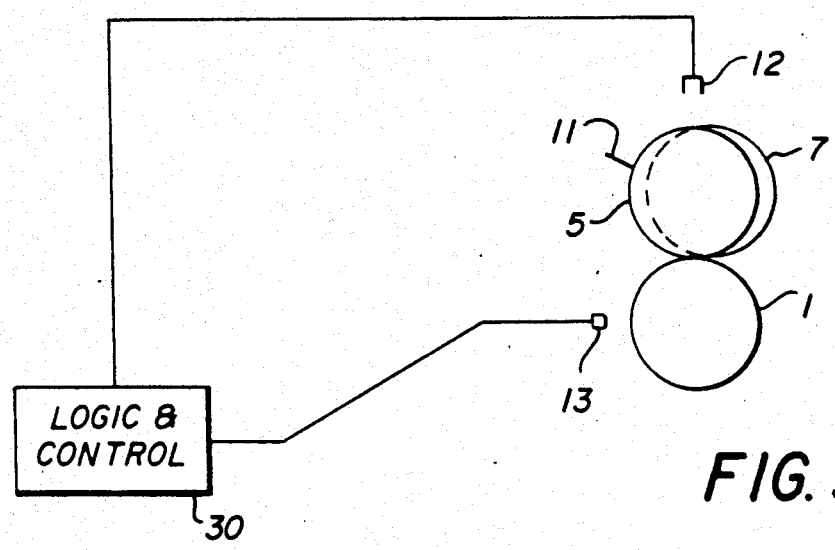

This process is illustrated in FIGS. 7–9. According to FIG. 7, roller 5 is in contact with drum 1 during image transfer. As shown in FIG. 8, after transfer, disk 7 separates transfer roller 5 from drum 1 and stepper motor 17 (FIG. 6) drives roller 5 until indicia 11 is sensed by sensor 12, at which point stepper motor 17 stops. The rotational position of drum 1 is also sensed, for example, by sensing an indicia 14 with a sensor 13 on the periphery of drum 1. Logic and control 30 receives signals from both sensors 12 and 13. In timed relation to receiving the signal from sensor 13 motor 17 is started again and driven until engagement of roller 5 with drum 1 is completed. Motor 17 is a high-quality stepper motor which is capable both of accurately positioning roller 5 at its home position and accurately driving it from that home position so that it is going at the same speed as drum 1 during engagement, which engagement is shown in FIG. 9. After engagement clutch 16 is disengaged and roller 5 is again driven by drum 1.

With the quality of stepper motor and sensors presently available, registration of a higher quality can be maintained between images than if the drum 1 is allowed to rotate the roller 5 through the entire cycle.

FIG. 10 illustrates this approach in an apparatus similar to that of FIG. 1. Note that a transfer roller 60 is driven by engagement with drum 1 except when a cam 70 rotating with roller 60 contacts drum 1 and disengages roller 60 therefrom.

FIG. 11 illustrates the type of transfer with which the structure shown in FIGS. 6–10 is particularly usable. According to FIG. 11, extremely small toner particles making up a toner image are transferred from drum 1 to a receiving sheet 75, which receiving sheet includes a thermoplastic outer layer 76. Layer 76 is heat softenable as is the toner. According to a process more thoroughly described in U.S. Pat. application Ser. No. 07/345,160, Rimai et al, METHOD OF NON-ELECTROSTATICALLY TRANSFERRING TONER, filed Apr. 28, 1989, the receiving sheet 75 and particularly outer layer 76 is raised to a temperature which softens the thermoplastic layer 76. This is accomplished by heating roller 60 internally, using heating lamp 62 and also may be accomplished by externally heating thermosplastic layer 76, for example, by externally located lamp 80. The heat of the receiving sheet 75 also heats the toner in the nip 10. The edges of the toner sinter or become soft. The layer of toner which first contacts the softened thermoplastic layer 76 becomes embedded in it and the rest of the toner which has also become soft or sintered sticks to the toner that is so embedded. Transfer is thus effected to the thermoplastic layer 76 as shown in FIG. 11. This process works best at relatively high pressures, for example, pressures well in excess of 100 pounds per square inch. Lower pressures are also effective, especially working with larger sized toners with more modest quality images on regular uncoated paper. Good thermal transfer from the interior of the roller 60 while maintaining relatively high pressures is best obtained if both drum 1 and roller 60 are hard rollers and do not contain a nip widening compliant surface. Again, for less high-quality work, especially with plain paper, roller 60 can have a slightly compliant surface as is more customary in the art.

It is common in many color copiers using a drum photoconductor to provide a substantial fly wheel driven with the drum to even out the rotation of the drum to avoid image defects. Defects that are repeated in all colors in the same way are less objectionable than a defect that occurs only in one color and not in others. The latter defect may show up as a shift in color and be quite noticeable. For that reason, it is common to have both the drum and transfer roller of the same size and form one image for each revolution of each. Thus, any variations in the periphery of the drum or transfer roller or variations that occur repeatedly in the motion of either will be repeated with each image and not show as a misregistration of colors.

As mentioned above, precision in the exposure station is one of the ingredients which provides extremely high quality results that makes an electrophotographic application competitive with regular photography. Referring to either FIGS. 1 or 10 it is noted that the transfer station and the exposure station are approximately 180° apart from each other. At the same time that the electronic exposure station 3 is writing an image, the transfer station is going through its cycle. The transfer station itself involves discontinuities in the mechanical interface between drum 1 and roller 60. For example, the registration arrangement illustrated in FIGS. 6–10 include an engagement step between the roller 60 and the drum 1 and a disengagement step. In between engagement and disengagement the drive for drum 1 drives both drum 1 and roller 60. While the two members are disengaged the drive for drum 1 need drive only drum 1. These discontinuities in the engagement between drum 1 and roller 60 can cause a variation in the motion of drum 1 which will affect the quality of exposure provided by electronic exposure station 3. In systems in which the drum 1 and roller 60 are not disengaged, the edges of the receiving sheet also provide a discontinuity, not nearly as large as that illustrated in FIGS. 6–9 but still capable of affecting imaging. This later variation of the problem will be discussed with reference to FIGS. 28–31.

Figure 12:
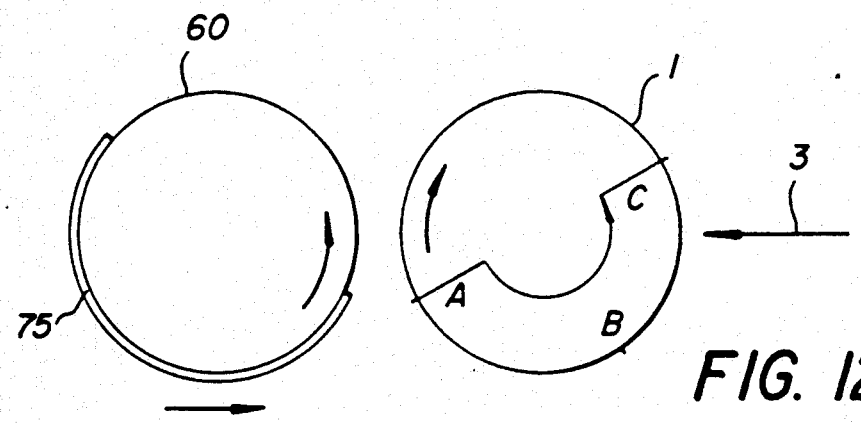
FIGS. 12, 13, 14 and 15 are side schematics of the transfer roller and imaging drum illustrating one approach to coordination of those members.

The affect of such discontinuities can be totally eliminated by not writing with exposure station 3 during the discontinuities. Such an arrangement is illustrated in FIGS. 12–15 in a system in which one image is created for each revolution of image member 1. According to FIG. 12, one-half or less of the circumference of drum 1 is written on as drum 1 passes exposure station 3. An image is written through an arc ABC as shown in FIG. 12 as drum 1 rotates in a clockwise direction past exposure station 3. The arrow inside the drum 1 illustrates the progressive direction of scan as seen by the drum 1, which is in the opposite direction to the rotation of drum 1 past exposure station 3.

Figure 13:
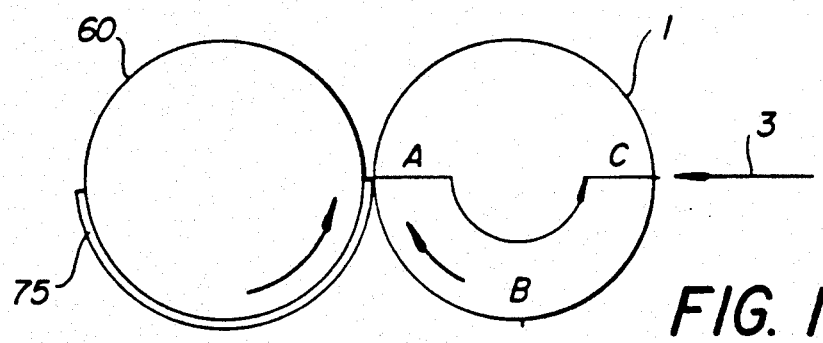
Figure 14:
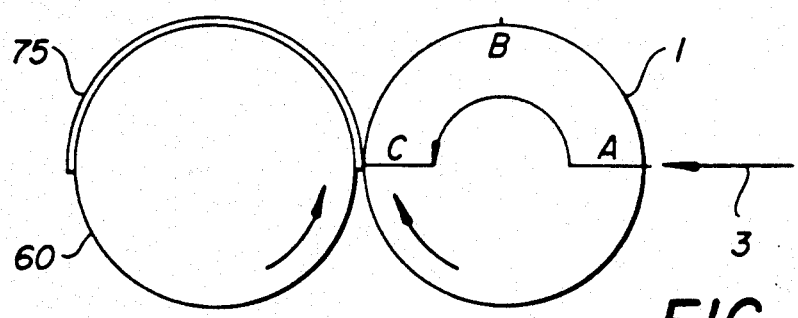
Figure 15:
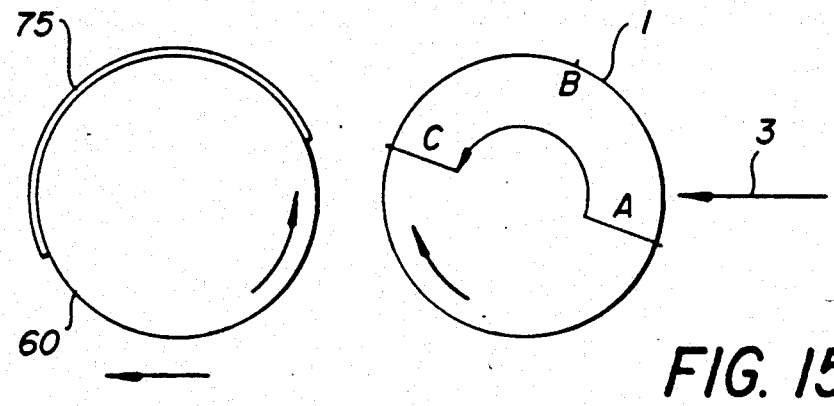

According to FIG. 13, roller 60 and drum 1 are engaged at the edge of transfer sheet 75. At substantially the same instant of engagement, the exposure station 3 is turned off having finished its scan. According to FIG. 14, transfer takes place through half a revolution of the drum 1 and roller 60. As transfer finishes with point C on drum 1 reaching the trailing edge of the receiving sheet 75, laser 3 begins its scan at point A and roller 60 is separated from drum 1 as shown in FIG. 15.

From the process described in FIGS. 12–15, it can be seen that both discontinuities at engagement and disengagement can be outside the scanning time of exposure station 3 if slightly less than one-half of drum 1 is used for that exposure. In fact, with the preciseness available with this system, very close to one-half of drum 1 can be used for such exposure. This system thus has a duty cycle of approximately 50%.

Figure 16:
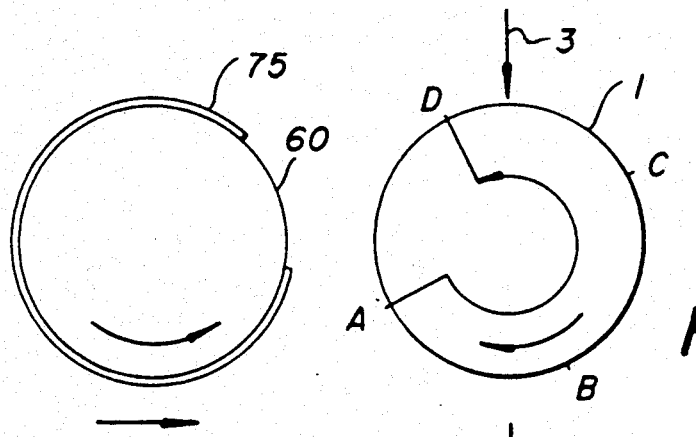
FIGS. 16–19, are side schematics similar to FIGS. 12–15 illustrating an alternative approach to coordination of those members.
Figure 17:
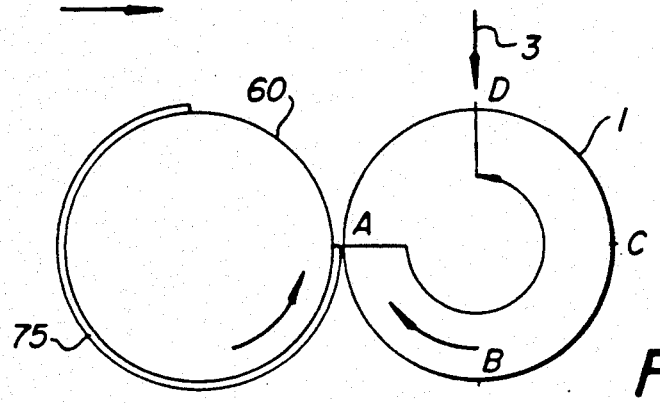
Figure 18:
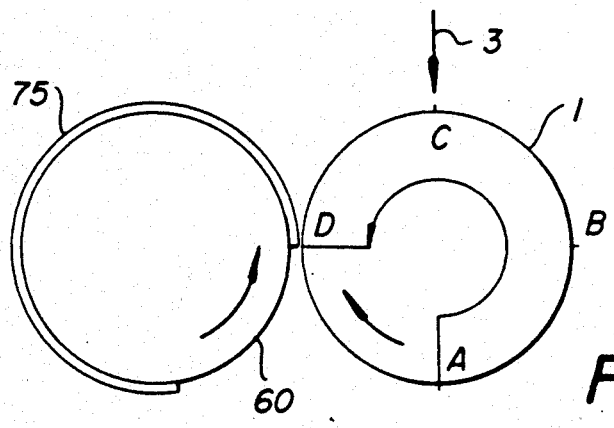
Figure 19:
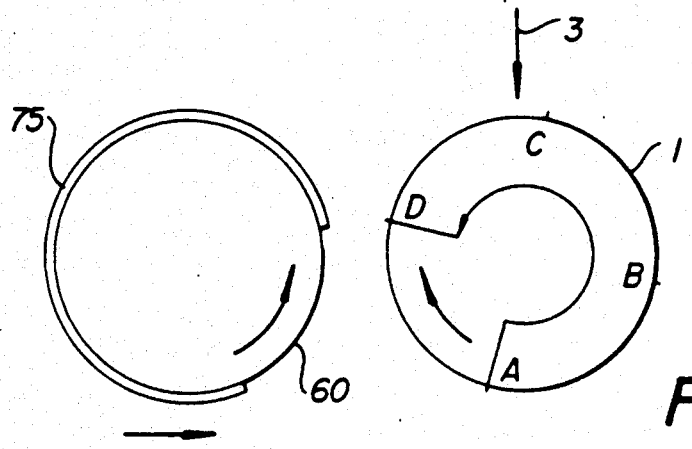
Figure 20:
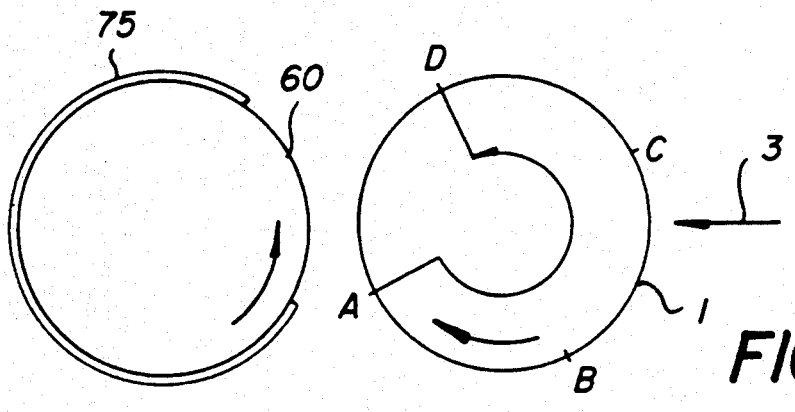
FIGS. 20–23 are side schematics similar to FIGS. 12–15 illustrating another approach to coordination of those members.
Figure 21:
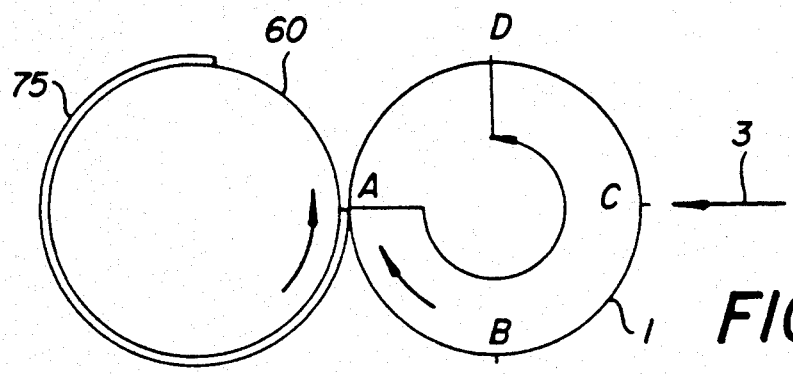
Figure 22:
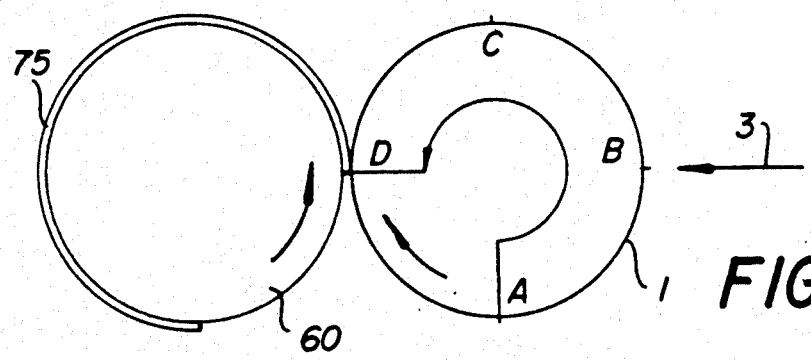
Figure 23:
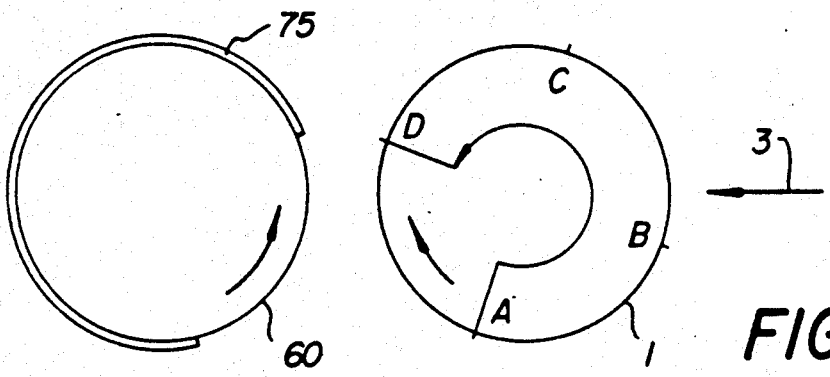
Figure 24:
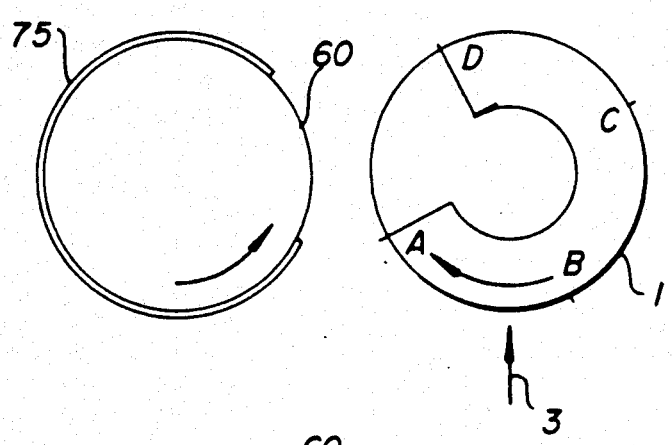
FIGS. 24–27 are side schematics similar to FIGS. 12–15 illustrating still another approach to coordination of the transfer roller and imaging drum.
Figure 25:
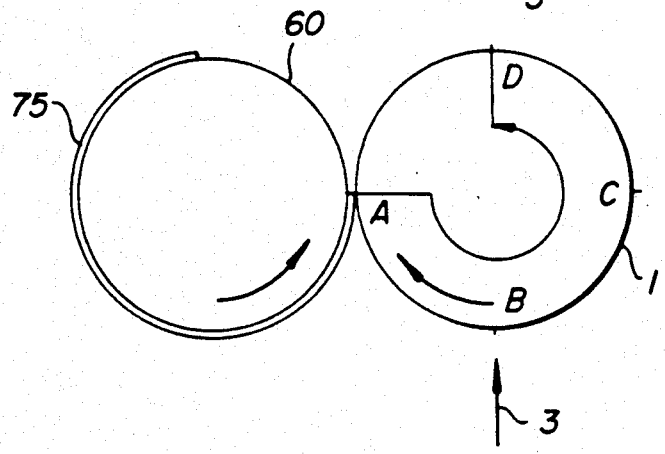
Figure 26:
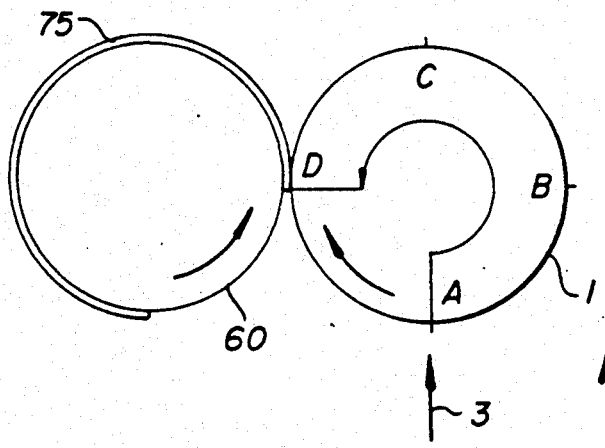
Figure 27:
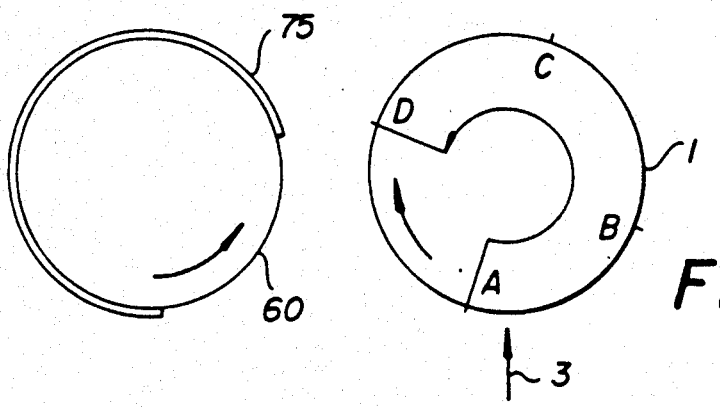

FIGS. 16–27 illustrate three approaches to increasing that duty cycle utilizing the imaging scheme described with regard to FIGS. 1–5. According to FIGS. 16–19, exposure station 3 is 90° from the transfer nip and three-fourths of the circumference of drum 1 is utilized in creating a large image made up of nine smaller images as diagrammed in FIG. 2. Laser exposure station 3 exposes the large image over an arc ABCD. The cross-track interfaces between small images occur at points B and C. This is true whether the long dimension or the short dimension is in the cross-track dimension because both dimensions are divided in thirds according to the FIG. 2 scheme. As shown in FIG. 16, roller 16 is being brought toward engagement with drum 1 as the scan of exposure station 3 approaches its end at point D. As shown in FIG. 17, engagement between roller 60 and drum 1 at point A occurs just as the point D is reached in the scan and the exposure station is turned off. According to FIG. 18 disengagement occurs as point D reaches the point of contact with roller 60. This occurs as point C is being scanned by exposure station 3. Point C is the boundary between the second and third sets of small images shown in FIG. 2. Any fluctuation in the motion of drum 1 would show up as an image artifact at or close to that boundary. Considering the preciseness of the system in general, it is likely that the artifact will occur at a place eliminated in the cutting operation. However, even if it is slightly displaced from that position, it occurs at the least objectionable portion of the image, that is, next to that boundary.

The condition shown in FIG. 17 of engagement involves both the impact of roller 60 moving into drum 1 and also the increased load of driving roller 60 by the drive system for drum 1 and is therefore the greater discontinuity. This system locates that defect essentially outside of any of the image areas with impact occurring as the laser quits writing. The effect of the separation of roller 60 which occurs at the position shown in FIG. 18 primarily is affected only by the immediate decrease in load on the drive system for drum 1. This discontinuity has less effect on image writing than does the condition in FIG. 17 of engagement. Its positioning with the writer at the point C is a preferred approach to reducing discontinuities in the writing overall.

The FIGS. 16–19 location of the exposure station 3 forces both the cleaning station and the charging station into the quadrant between the transfer nip and that exposure station. Some machine configurations may not lend themselves to locating those two stations in such a limited space. FIGS. 20–23 show an alternative approach, similar to FIGS. 16–19, but which allows more space for the cleaning and charging stations. According to FIGS. 20–23, the exposure station is located directly opposite the transfer station as in FIGS. 12–15. However, the impact of engagement shown in FIG. 21 occurs when the exposure station 3 is at point C, the boundary between the second and third sets of small images shown in FIG. 2. Disengagement, shown in FIG. 22, then occurs at point B which is the boundary between the first and second set of small images in FIG. 2. In this embodiment, both discontinuities occur within the large image but at a boundary between the small images. Although this is not as desirable from an image defect standpoint as the embodiment shown in FIGS. 16–19, it is superior in terms of machine geometry.

FIGS. 24–27 show a third location for the exposure station 3. With this approach, engagement shown in FIG. 25 occurs when point B is being written while disengagement occurs as point A is being written. This approach, while acceptable, is inferior to the other two embodiments in that the larger discontinuity of engagement (FIG. 25) occurs while writing at one of the boundaries between small images rather than outside or nearly outside of the entire large image area. At the same time, from a machine geometry standpoint all of the toning stations must be crowded between the exposure station and the transfer nip. For some toning stations, this would be impossible. However, if toning stations are cycled into and out of position as in some color apparatus, the FIG. 24 through 27 embodiment could be used.

Larger-size prints, for example, those made with the image arrangements shown in FIGS. 3–5 will generally end up with the image defect in the images. The larger the overall image, the less serious is a given size of defect. Thus, for the larger sizes the defect may be acceptable. However, if it is not acceptable in very high quality work, the larger images can be done at lower productivity than snapshots, skipping every other frame to avoid the defect entirely. Note that the FIG. 4 arrangement of 5×7's could be used without the two images on the left side and the discontinuities would occur while the lasers were writing in the borders between the other three images.

FIGS. 28–31 show another variation of the apparatus shown in FIGS. 6–10. The cam disks 7 and 8 in FIGS. 6–9 and the cam 70 are replaced by a pair of disks 161 and 162 shown in FIGS. 28 and 29. According to FIG. 28, internally heated transfer roller 60 is driven by engagement with drum 1 during transfer as in FIG. 10. A stepper motor 117 drives roller 60 through shaft 125 when between transfers.

Figure 29:
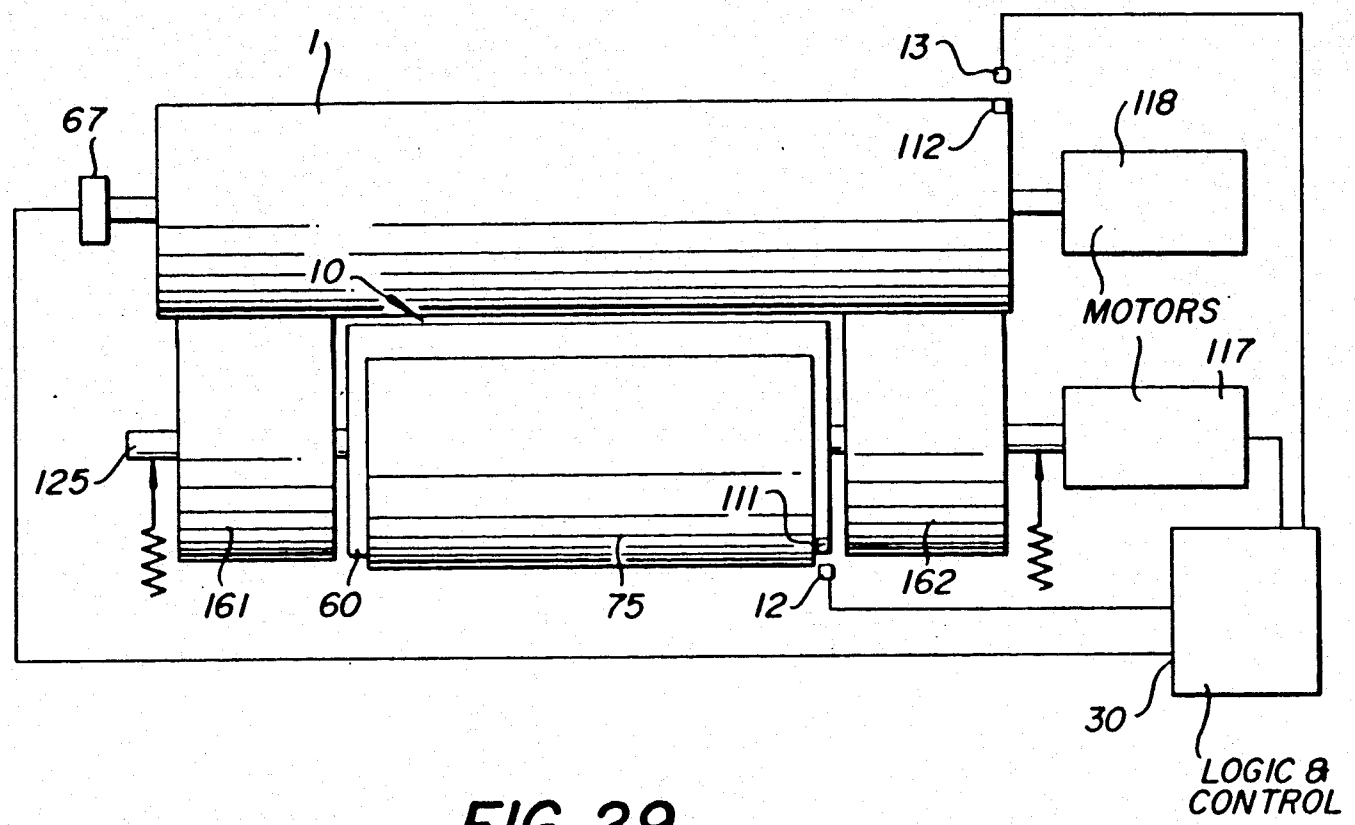

Disks 161 and 162 have a radius slightly less than the combined radius of heated transfer roller 60 and receiving sheet 75 when sheet 75 is compacted by drum 1 and heated roller 60 in the nip 10. Shaft 125 is spring loaded as shown to obtain the desired pressure for transfer. As shown in FIG. 29, at the end of transfer, as the receiving sheet 75 leaves the nip, the loaded shaft 125 moves toward drum 1 until disks 161 and 162 contact the surface of drum 1 outside the image area.

Disks 161 and 162 are mounted on shaft 125 and are free to rotate with respect to it. As shown in FIG. 29, roller 60 is now separated from drum 1 and can be rotated by motor 117 through shaft 125, essentially as described with respect to FIG. 6. That is, stepper motor 117 rotates roller 60 until it reaches a home position as controlled by sensor 12 sensing a mark 111 on the periphery of roller 60. Roller 60 is then rotated from its home position in timed relation to rotation of drum 1. This can be controlled by sensor 13 which senses a mark 112 on drum 1 or by encoder 67, or both. Drum 1 is driven by a motor 118 and may also include a flywheel (not shown) to steady its movement.

Figure 28:
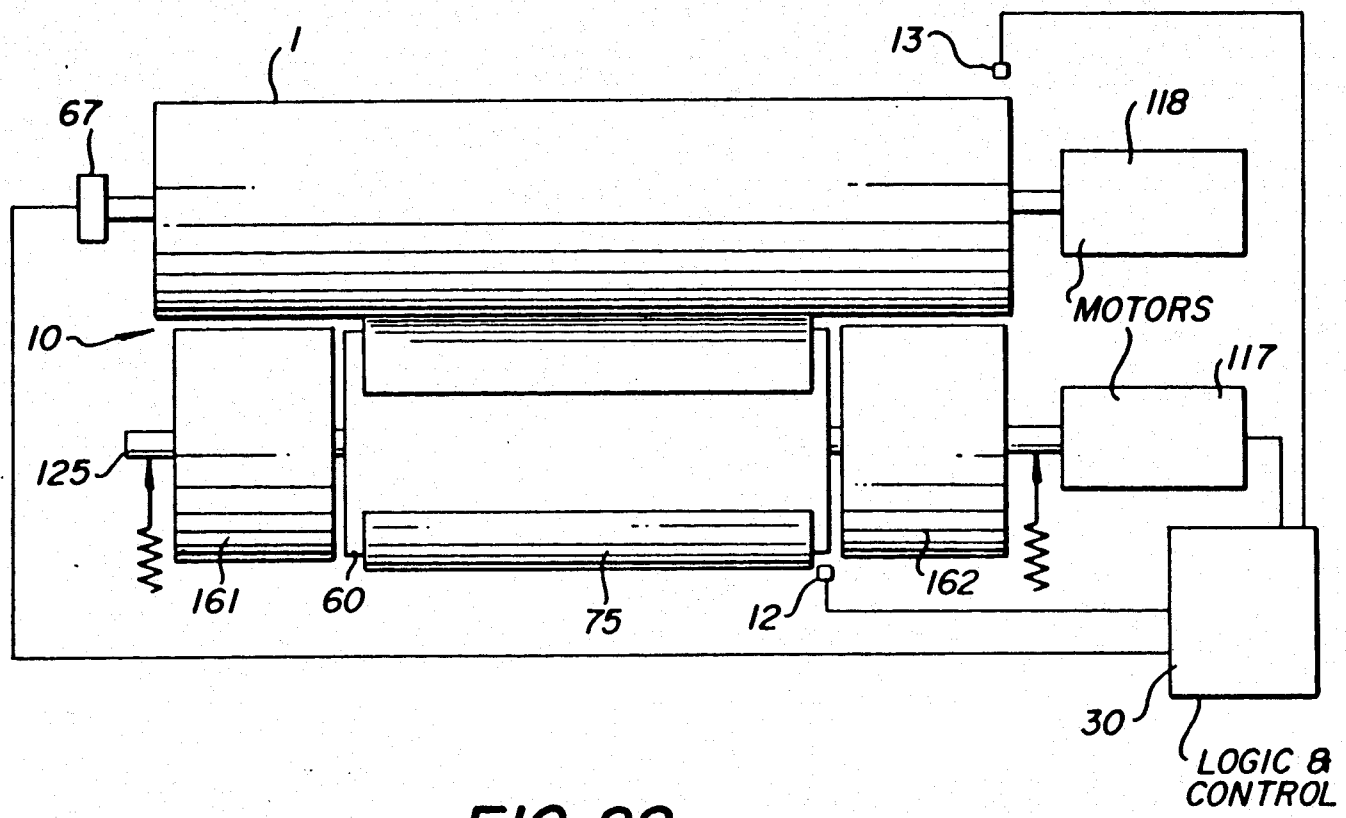
FIGS. 28 and 29 are top views of two different instances in the revolution of an alternative transfer roller drum embodiment to that shown in FIGS. 6–10.

The thickness of receiving sheet 75 and the separation between drum 1 and disks 161 and 162 have been exaggerated in FIGS. 28 and 29 to aid the explanation. Disks 161 and 162 can be made less than 0.002 inches in radius less than the radius of the compacted receiving sheet and roller. Thus, the movement from the edge of the receiving sheet to the disks is very slight. Nonetheless, even that small an impact can result in a discontinuity of visible proportions at the exposure station.

Figure 30:
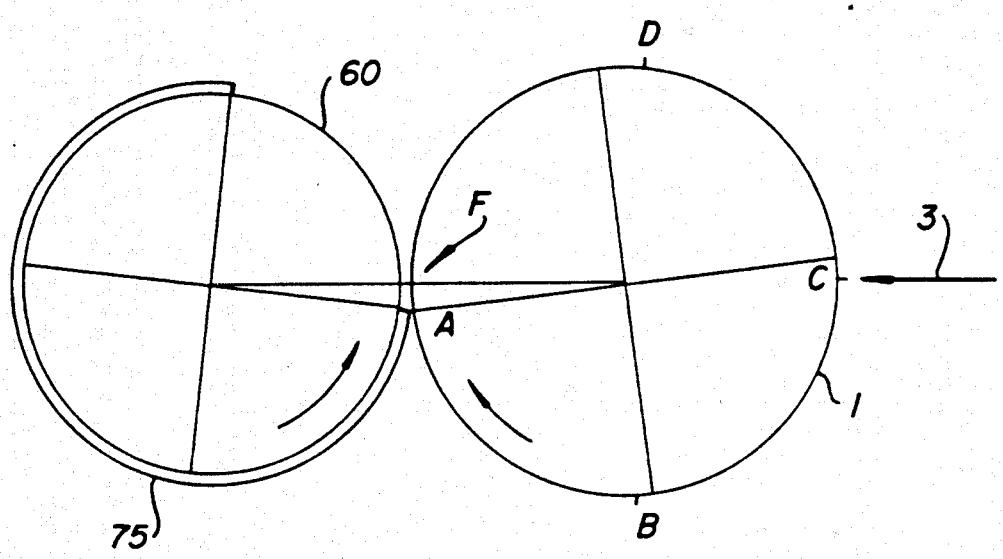
FIGS. 30 and 31 are side schematics similar to FIGS. 13–14 illustrating coordination of the transfer roller and imaging drum shown in FIGS. 28 and 29.
Figure 31:
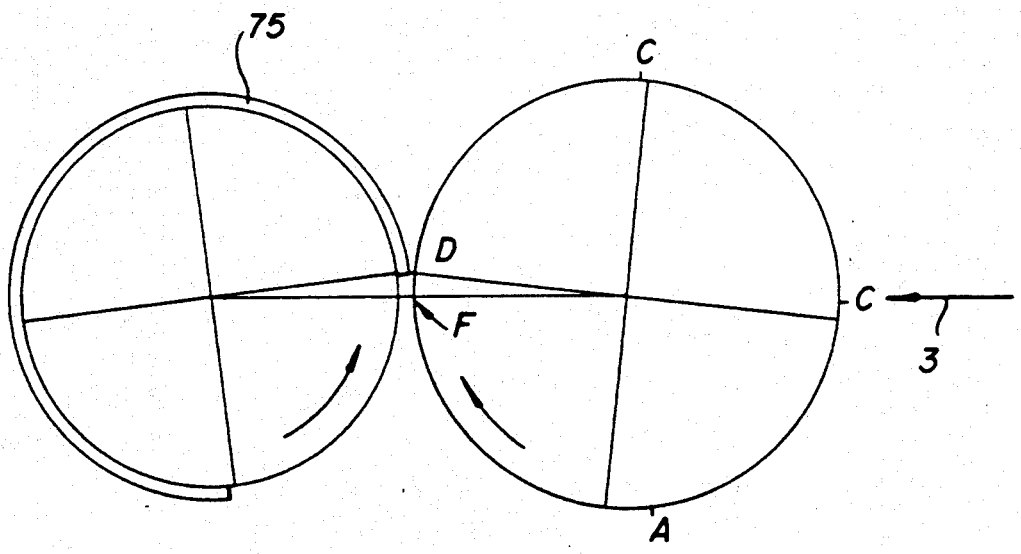

The discontinuities in such a system do not occur exactly as shown in FIGS. 12–27, i.e., at the center of the nip. The thickness of the receiving sheet 75 will cause engagement slightly upstream of the nip center and will cause disengagement slightly downstream of the nip center. In systems like that shown in FIGS. 28 and 29 in which the transfer roller 60 is reindexed for each image, this variation can be compensated for by making drum 1 slightly larger in diameter than the combined diameter of roller 60 at its operating temperature and receiving sheet 75. This refinement is shown in FIGS. 30 and 31. According to FIGS. 30 and 31, the circumference of drum 1 is made larger by an amount that will compensate for the width of the nip, i.e., the distance between the points of engagement and disengagement. In the FIGS. 30–31 example, the circumference of drum 1 should equal the circumferential distance between the points of discontinuity (the distance between the point A in FIG. 30 at engagement and point D in FIG. 31 at disengagement) plus 4/3rds of the length (in the in-track direction) of the receiving sheet 75. Since the roller and drum are reindexed for each image the circumference of the roller 60 is immaterial, needing to be only big enough to accept sheet 75.

With this arrangement, exposure station 3 is 180° from the center of the nip, point F, and the discontinuities felt by drum 1 occur when point C (FIG. 30) and point B (FIG. 31) are being written. Since they occur on the boundary between images (FIG. 2) they do not affect image quality. The overall arrangement, FIGS. 28–31, provides the high quality registration of FIGS. 6–10 but with a simpler mechanism.

The invention has been described in detail with particular reference to a preferred embodiment thereof, but it will be understood that variations and modifications can be effected within the spirit and scope of the invention as described hereinabove and as defined in the appended claims.

We claim:

1. Color printing apparatus, comprising:

an image drum rotatable through an endless path, means for forming a series of large electrostatic images on said image drum as it moves through said path, each large image of said series of images representing a color separation of a multicolor image and each large image being made up of an array of smaller images, said array having at least one boundary between smaller images that runs in a generally cross-track direction, means for applying toners of different colors to said series of large electrostatic images to create a series of different color toner images corresponding to said electrostatic images, means for transferring said series of toner images in registration to a single receiving sheet to create a multicolor image thereon, said transfer means including a transfer roller for holding a receiving sheet on its periphery and positioned to bring said receiving sheet into contact with said drum as said roller rotates said receiving sheet repeatedly through transfer relation with said drum, contact between said receiving sheet and said drum causing at least one discontinuity in the rotation of said drum, and said image forming means including means for incrementally forming said electrostatic image as said drum rotates past said image forming means, said image forming means being positioned to form said cross-track boundary between smaller images when said discontinuity in the rotation of said drum occurs.

2. Apparatus according to claim 1 wherein said transfer means includes means for applying a combination of heat and pressure in a nip between said drum and roller to transfer said toner images.

3. Color printing apparatus, comprising:

a photoconductive image drum rotatable through an endless path, electronic exposure means for forming a series of large electrostatic images on said image drum as it moves through said path, each large image being made up of an array of smaller images, said array having at least one boundary between smaller images that runs in a generally cross-track direction, means for applying toners of different colors to said series of large electrostatic images to create a series of different color toner images corresponding to said electrostatic images, means for transferring said series of toner images in registration to a single receiving sheet to create a multicolor image thereon, said transfer means including a transfer roller for holding a receiving sheet on its periphery and positioned to bring said receiving sheet into contact with said drum as said roller rotates repeatedly through transfer relation with said drum, contact between said receiving sheet and said drum causing at least one discontinuity in the rotation of said drum, and said electronic image forming means including means for incrementally exposing said photoconductive drum as said drum rotates past said exposure means, said exposure means being positioned to expose said cross-track boundary between smaller images when said discontinuity in the rotation of said drum occurs.

4. Color printing apparatus, comprising:

a photoconductive image drum rotatable through an endless path, electronic exposure means for forming a series of large electrostatic images on said image drum as it moves through said path, each large image being made up of an array of smaller images, said array having at least two boundaries between smaller images that run in a generally cross-track direction, means for applying toners of different colors to said series of large electrostatic images to create a series of different color toner images corresponding to said electrostatic images, means for transferring said series of toner images in registration to a single receiving sheet to create a multicolor image thereon, said transfer means including a transfer roller for holding a receiving sheet on its periphery and positioned to bring said receiving sheet into engagement with said drum as said roller rotates repeatedly through transfer relation with said drum, and means for providing a separation between said roller and drum between transfers, the leading and trailing edges of said receiving sheet causing a discontinuity in the motion of said drum, and said electronic exposure means including means for incrementally exposing said photoconductive drum as said drum rotates past said exposure means, said exposure means being positioned to expose said cross-track boundaries between smaller images when said discontinuity in the rotation of said drum occurs.

5. Apparatus according to claim 4 wherein said exposure means is located approximately 90 degrees around said drum from the center of a nip formed between the drum and roller during transfer.

6. Apparatus according to claim 4 wherein said exposure means is located approximately 90 degrees around said drum from the center of a nip formed between the drum and roller during transfer in a direction downstream from said nip.

7. Color printing apparatus according to claim 4 wherein the circumference of the drum is larger than 4/3rds of the length of the receiving sheet by the distance between the positions of the leading and trailing edges when causing said discontinuities and wherein said cross-track boundaries divide said large images into substantially equal thirds.

8. Color printing apparatus, comprising:

a photoconductive image drum rotatable through an endless path, electronic exposure means for forming a series of large electrostatic images on said image drum as it moves through said path, each large image being made up of an array of smaller images, said array having two cross-track boundaries between smaller images that divide the large image into equal thirds, means for applying toners of different colors to said series of large electrostatic images to create a series of different color toner images corresponding to said electrostatic images, means for transferring said series of toner images in registration to a single receiving sheet to create a multicolor image thereon, said transfer means including a transfer roller for holding a receiving sheet on its periphery and positioned to bring said receiving sheet into engagement with said drum as said roller rotates repeatedly through transfer relation with said drum, and means for establishing a separation between said roller and drum between transfers, for reindexing said roller and for reengaging said receiving sheet and said drum, said separation and reengagement causing discontinuities in the motion of said drum, and said electronic exposure means including means for incrementally exposing said photoconductive drum as said drum rotates past said exposure means, said exposure means being positioned to expose said cross-track boundaries between smaller images when said discontinuities in the rotation of said drum occur.

9. Apparatus according to claim 8 wherein said exposure means includes a laser.

10. Apparatus according to claim 9 wherein said exposure means is located approximately 180 degrees around said drum from the center of a nip formed between the drum and roller during transfer.

11. Apparatus according to claim 8 wherein said exposure means is located approximately 180 degrees around said drum from the center of a nip formed between the drum and roller during transfer.

12. Apparatus according to claim 11 wherein said drum has a circumference greater than four thirds times the length of said transfer sheet by an amount equal to the distance along the path of the periphery of the drum between the locations of the engagement and the separation of said receiving sheet and said drum.

13. A multicolor image forming apparatus, comprising:

a photoconductive drum rotatable to bring its periphery through an endless path, stationary scan means for scan exposing the surface of said drum as it passes thereby to create a series of electrostatic images thereon, means for toning said series of electrostatic images with toners of different colors to create a series of different color toner images, means for transferring said different color toner images in registration to a receiving sheet, said transfer means including, a transfer roller, means for securing a receiving sheet to the periphery of the transfer roller, means for urging said transfer roller and photoconductive drum into pressure contact, characterized in that said roller and drum have a cycle of operation in which the pressure contact therebetween creates at least two discontinuities in the motion of said drum and wherein the parameters of the drum, the roller, the image length and the position of the stationary scan means are chosen so that said scan is effected during a portion of said cycle when at least one of said discontinuities does not occur.

14. Apparatus according to claim 13 wherein said large image is made up of a plurality of smaller images which smaller images have boundaries between them running across the path of movement of the surface of said photoconductor and wherein the said parameters of said system are chosen such that such discontinuities occur either while not scanning or while scanning one of said boundaries.

* * * * *